United States Patent [19]

Lillibridge

[11] Patent Number: 4,504,260

[45] Date of Patent: Mar. 12, 1985

[54] METHOD AND APPARATUS FOR SCORING AND FOLDING ENVELOPES

[75] Inventor: Harold R. Lillibridge, Bulingame, Calif.

[73] Assignee: Champion International Corporation, Stamford, Conn.

[21] Appl. No.: 439,728

[22] Filed: Nov. 8, 1982

[51] Int. Cl.[3] ..... B31B 21/26

[52] U.S. Cl. ..... 493/249; 493/254; 493/245; 493/263

[58] Field of Search ..... 493/249, 254, 263, 262, 493/261, 260, 420, 434, 917

[56] References Cited

U.S. PATENT DOCUMENTS

| | | | |
|---|---|---|---|
| 2,307,907 | 1/1943 | Becker | 493/249 |
| 2,731,891 | 1/1956 | Weisshuhn | 493/254 |
| 3,116,668 | 1/1964 | Novick | 493/249 |
| 3,641,883 | 2/1972 | Smith | 493/249 |
| 3,793,926 | 2/1974 | Honsel | 493/254 |
| 4,338,085 | 7/1982 | Sullivan | 43/241 |

*Primary Examiner*—Leon Gilden

*Attorney, Agent, or Firm*—Evelyn M. Sommer; William W. Jones

[57] ABSTRACT

Envelope blanks are scored and folded by pressing the flat blanks through a series of scoring and folding rolls. The rolls include vacuum rolls which invert the envelope blanks during the scoring operation. The blanks are scored laterally and as they pass over the outer surface of one of the vacuum rolls they are scored longitudinally. During the longitudinal scoring operation, the envelopes are curvilinear due to their being drawn down onto one of the vacuum rolls. After the longitudinal scoring operation, the blanks are inverted by being folded along the transverse score. The inverted, folded blanks are then moved along by a pair of cooperating vacuum rolls to a gumming station. After being gummed, the blanks are folded along their longitudinal scores with the folded flaps being secured in place by the gum.

18 Claims, 4 Drawing Figures

METHOD AND APPARATUS FOR SCORING AND FOLDING ENVELOPES

This invention relates to a method and apparatus for scoring and folding envelope blanks, and more particularly, to the scoring and folding of blanks which are adapted for storing items, such as floppy computer disks.

Storage envelopes, as with other types of envelopes, are formed from pre-cut blanks which are fed into an apparatus which scores, gums and folds the blanks into envelopes. One such apparatus is disclosed in U.S. Pat. No. 4,338,085, issued July 6, 1982 to J. Sullivan and H. R. Lillibridge. The method and apparatus of this invention constitute an improvement over the subject matter of the aforesaid patent the disclosure of which is specifically incorporated herein by reference.

Envelope blanks are scored and folded in accordance with this invention by feeding flat pre-cut blanks into the nip of a pair of lateral scoring rolls which form a lateral score on the blank. One of the lateral scoring rolls is a vacuum roll which operates to pull the blank into conformity with the outer surface of the vacuum roll. As the blank travels around the vacuum roll, the longitudinal scores are formed on the blank. The leading edge of the blank then leaves the vacuum roll and is fed into a closed ended chute. Advancement of the leading edge of the blank is stopped by contact with the closed end of the chute while the trailing edge of the blank continues to be advanced by the vacuum roll. The continued advancement of the trailing edge of the blank coupled with the cessation of movement of the leading edge of the blank causes the blank to be inverted and folded about its lateral score line. The folded lateral score line then becomes the leading edge of the folded blank. When the folded blank breaks off contact with the vacuum roll, the leading edge of the inverted folded blank is picked up by a pair of vacuum feed rolls and is moved through the nip of the vacuum feed rolls into contact with chain-mounted pins which contact, align and advance the folded blank to a pair of cooperating carrier belts. The carrier belts advance the folded blank through a gumming station where gum is applied to locations on the blank adjacent to the longitudinal folds. The gummed blanks are then advanced by the belts through ploughshares where the gummed flaps are folded along the longitudinal fold lines to complete formation of the envelopes.

It is, therefore, an object of this invention to provide an improved method and apparatus for scoring and folding envelope blanks.

It is an additional object of this invention to provide a method and apparatus of the character described wherein the blanks are scored laterally and longitudinally, inverted, and folded laterally before being gummed and folded longitudinally.

It is a further object of this invention to provide a method and apparatus of the character described wherein the blanks are scored longitudinally while following a curvilinear path over the periphery of a scoring roll in the initial stages of being inverted.

These and other objects and advantages of this invention will be more readily apparent from the following detailed description of a preferred embodiment of a method and apparatus applying the principles of this invention when taken in conjunction with the accompanying drawings, in which.

Figure 1:
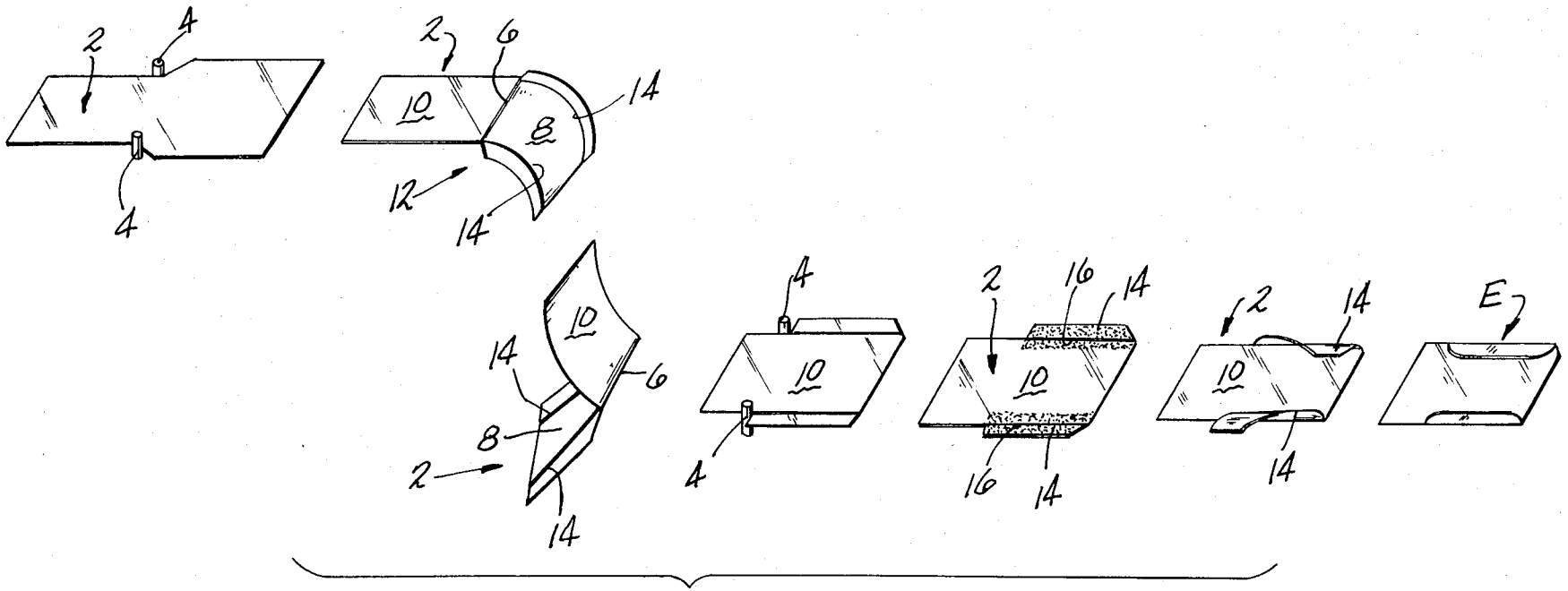
FIG. 1 is an schematic perspective view showing the path that the envelope blanks take during the scoring, folding and gumming operation of this invention.

Referring now to FIG. 1, there is shown in somewhat schematic form the path which an envelope blank traverses during the scoring, folding and gumming operation of this invention. Each blank, denoted by the numeral 2, is moved into the scoring portion of the apparatus by a pair of pins 4 which are mounted on endless chains (not shown). The blanks 2 are fed from the pins 4, and while in the scoring portion of the apparatus, a lateral score line 6 is formed on the blanks 2 to divide the latter into two portions 8 and 10 respectively. The portion 8 is fed along a curvilinear path 12 wherein longitudinal score lines 14 are formed on the portion 8 of the blank 2. After the longitudinal score lines 14 are formed the portion 10 of the blank 2 is moved along the curvilinear path 12 and movement of the portion 8 of the blank 2 is momentarily stopped. Cessation of movement of the portion 8 of the blank 2 combined with continued movement of the portion 10 of the blank 2 causes the blank 2 to be inverted and folded about the lateral score line 6. The inverted, laterally folded blank 2 is then transferred out of the scoring portion of the apparatus and picked up once more by the pins 4 to be transferred to cooperating carrier belts (not shown) which move the blanks 2 to a gumming mechanism (not shown) which applies strips of gum 16 to the blanks 2 adjacent to the longitudinal score lines 14. The gummed, laterally folded blanks 2 are then moved by the carrier belts through cooperating ploughshares (not shown) which fold the blanks 2 about the longitudinal score lines 14 to adhere the gummed portions together. The finished envelope E is then fed to a removal station on the apparatus.

Figure 2:
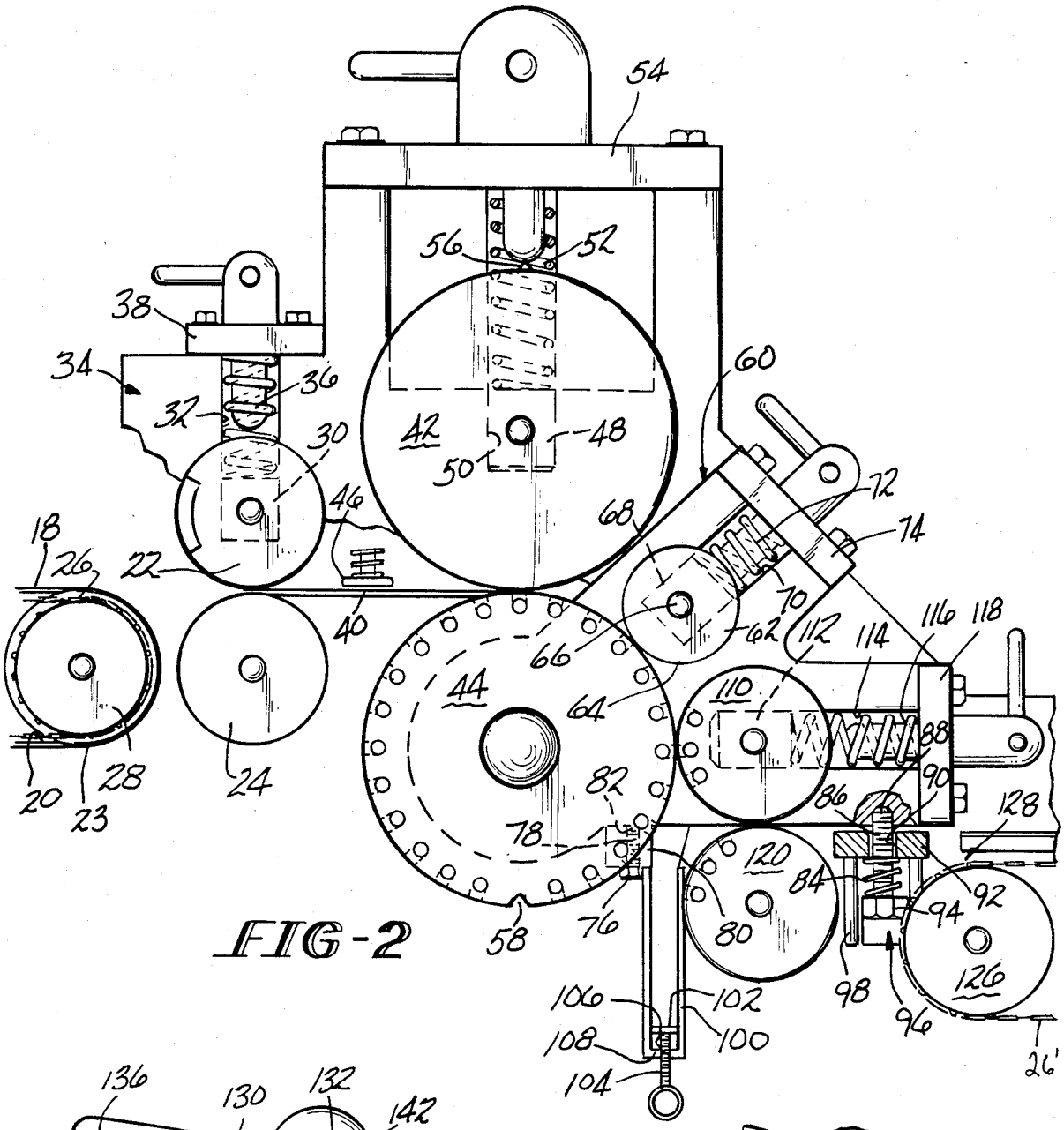
FIG. 2 is a side elevational view of the envelope blank scoring and lateral folding portion of a preferred embodiment of an apparatus formed in accordance with this invention.

Referring now to FIG. 2, the scoring and lateral folding station on the apparatus of this invention is shown. The precut blanks are disposed between a pair of endless belts 18 and 20 respectively. The endless chains 26 (shown in phantom) which carry the pins 4 (shown in FIG. 1) are driven by sprockets 28. The blanks are disposed between the belts 18 and 20 and are engaged by the pins 4 mounted on the chains 26 whereby the blanks are moved from left to right as viewed in FIG. 2. The belts 18 and 20 are advanced more slowly than the chains 26 so as to ensure that the pins 4 properly engage the blanks to align the latter in the apparatus. A feed roll 22 is mounted in a pair of vertically deflectable bearings 30 which in turn are carried in a well 32 formed in frame support member 34 which support the sides of the apparatus. A coil spring 36 is disposed in the well 32 to bias the bearings 30, and thus the roll 22, downwardly toward the blanks being fed through the apparatus. Thus a flexible nip is formed betwen the rolls 22 and 24. A cap 38 spans the top of the well 32 and contains a pressure plate which allows release of the pressure caused by the spring 36 in case of a jam of blanks occurring between the rolls 22 and 24, as will be explained in greater detail hereinafter.

The blanks are fed from the nip of the rolls 22 and 24 onto a transfer plate 40 which, in turn transfers the blanks into the nip of a pair of scoring rolls 42 and 44. A jam sensor 46 is mounted above the transfer plate 40 and is operable to turn the apparatus off when a blank jam is detected. The roll 42 is mounted in a bearing 48 which reciprocates in a well 50 formed in the support frame 34. A spring 52 biases the bearing 48 downwardly so as to bias the roll 42 toward the roll 44. A cap 54 spans the well 50 and houses a pressure plate which controls the pressure exerted by the spring 52 on the bearing 48, as will be explained in greater detail hereinafter. The roll 42 is provided with a lateral scoring rib 56 and the roll 44 is provided with a vacuum so that the roll 44 can grip and advance blanks fed from the transfer plate 40.

A yoke 60 is mounted adjacent to the roll 44 for pivotal movement about the axis of rotation of the roll 44. A longitudinal scoring roll 62 having a pair of scoring ribs 64 is mounted for rotational movement about a shaft 66, the ends of which are journaled in a bearing 68 which is slidably mounted in a well 70 formed in the yoke 60. A spring 72 is mounted in the well 70 to bias the bearing 68, and thus the roll 62, toward the roll 44. A cap 74 closes the top of the well 70. The angular position of the yoke 60 is adjustable by means of a threaded adjustment member 76 which is screwed into a threaded bore 78 formed in a fixed block 80 secured to the support frame 34. The inner end of the member 76 bears against the yoke 60 at point 82. The yoke 60 is biased in the clockwise direction about its pivotal axis by means of a spring 84 which is mounted on a bolt 86. The bolt 86 is threaded into the yoke at 88 and passes through an oversize bore 90 formed in a fixed block 92 secured to the support frame 34. A nut 94 provides a bearing surface for one end of the spring 84, while the block 92 provides a bearing surface for the other end of the spring 84. Thus the yoke 60 is free to float up and down about its pivotal axis. A release mechanism 96 is mounted on a clevis 98 on the block 92 and is operable to compress the spring 84 to swing the yoke 60 in a counter-clockwise direction to release any blank jams which may occur. Operation of the release mechanism 96 will be set forth in greater detail hereinafter.

When the blanks are fed into the nip of the rolls 42 and 44, the vacuum maintained in the roll 44 causes the blank to be drawn down onto and in conformity with the outer surface of the roll 44. As the blank passes between the rolls 42 and 44 the lateral score line 6 (see FIG. 1) is formed on the blank by the scoring rib 56. As the blank continues around the roll 44 while being drawn by the vacuum into conformity with the outer surface of the roll 44, the longitudinal score lines 14 (see FIG. 1) are formed on the blank. By forcing the blank to assume a curvilinear configuration during the longitudinal scoring operation, the likelihood of wrinkling of the blank during the scoring is substantially reduced due to the fact that the curvilinear configuration of the blank increases its strength. The laterally and longitudinally scored blank then continues to be fed around the roll 44 until its leading edge is fed into a chute 100. The chute 100 is formed with a blind end formed by a plate 102 which is adjustable longitudinally of the chute 100 by reason of being carried on the end of a threaded member 104 which is screwed into a threaded hole 106 formed in the lower end wall 108 of the chute 100. Mobility of the plate 102 within the chute 100 allows for adjustment to accommodate different length blanks on the apparatus. With the leading edge of the blank being immobilized by engagement with the plate 102, continued advancement of the remainder of the blank by the vacuum roll 44 causes the blank to fold about its lateral score line 6 once the lateral score line 6 passes through the nip of the roll 44 and a feed roll 110. Thus the blank will be inverted and the lateral fold line will become the leading edge of the laterally folded blank as the latter moves further through the apparatus.

The ends of the roll 110 are mounted on a bearing 112 which is reciprocally mounted in a well 114 formed in the yoke 60. A spring 116 mounted in the well 114 biases the bearing 112 and thus the roll 110, toward the roll 44. A cap 118 closes the open end of the well 114. The roll 110 cooperates with a roll 120 to provide means for feeding the laterally folded, inverted blanks out of the chute 100. Both of the rolls 110 and 120 are provided with portions of their outer surfaces which are evacuated so that the laterally folded inverted blanks disposed on the chute 100 will be grasped and pulled out of the chute 100 by the evacuated rolls 110 and 120. A second chain 26' which carries the pins 4 is mounted on a drive sprocket 126 and the chain 26' picks up the folded, inverted blanks at the point 128 downstream of the feed rolls 110 and 120 where the pins 4 are once again moved into position to engage the laterally folded and inverted blanks to move the latter away from the feed rolls 110 and 120. The chain 26 and pins 4 then move the blanks serially into engagement with a pair of carrier belts (not shown) which pick up the blanks and move them through a gumming station and thence through cooperating ploughshares (not shown) where the blanks are folded along their longitudinal score lines to form the erected envelopes.

It will be understood that while only one support frame 34 is shown in FIG. 2, and one bearing 30, 48, 68 and 112, and one yoke 60 are also shown in FIG. 2, these devices are all provided in duplicate, one on each side of the various rolls depicted.

Figure 3:
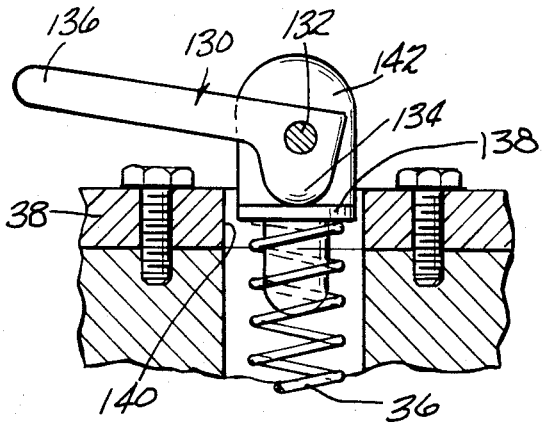
FIG. 3 is a fragmented vertical sectional view of the cam release mechanism used to release certain of the rolls from their operable positions in case of a jam in the apparatus.

Referring now to FIG. 3, there is disclosed details of the various blank jam releases provided in the caps 38, 54, 74 and 118. It will be understood that all of these jam releases operate in a similar manner. Each release includes an operating lever 130 which is pivotal about a pin 132 and which includes a camming portion 134 and an arm portion 136. The camming portion 134 engages a pressure plate 138 against which the various springs, such as 36, bear. The plate 138 is disposed in a bore 140 through the cap 38. The pin 132 extends between a pair of spaced pin supports 142. In the position shown in FIG. 3, the spring 36 is compressed by the pressure plate 138 so as to bias the various bearings, such as 30 (see FIG. 2) inwardly. When a blank jam occurs, the arm 136 is grasped and the lever 130 is pivoted in the clockwise position to release the pressure exerted on the spring 36 by the plate 138. This releases the bias pressure on the respective roll, such as 22, so that the jam can be cleared. When the jam is cleared, the lever 130 is pivoted back to the position shown, and operation of the apparatus is resumed.

Figure 4:
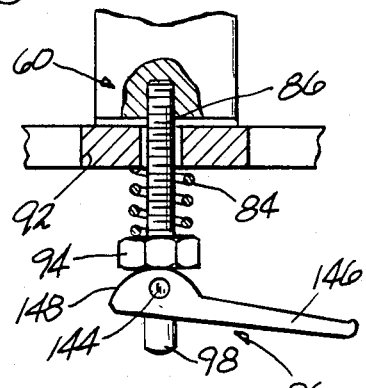
FIG. 4 is a fragmented vertical sectional view of the cam release mechanism used to release the roll-mounting yokes from their operable positions in case of a jam in the apparatus.

Referring to FIG. 4, the jam release mechanism 96 used in conjunction with the yoke 60 is shown. The mechanism 96 is pivotably mounted on a pin 144 extending between the clevis components 98. The mechanism 96 includes a lever portion 146 and a camming portion 148. When a blank jam occurs, the lever 146 is grasped and the mechanism 96 is pivoted about the pin 144 in the clockwise direction. This causes the camming portion 148 to move against the outer end of the bolt 86 and push the latter upwardly to compress the spring 84. Upward movement of the yoke 60 away from the block 92 thus permits release of yoke pressure on the jammed blanks so that the jam can be cleared. Once the jam is cleared, the mechanism 96 is pivoted back to the position shown in FIG. 4 and operation of the apparatus is continued.

It will be readily appreciated that the method of inverting and folding an envelope blank utilized by the apparatus of this invention will permit a shortening of the length of the apparatus. Furthermore, scoring the blanks while they follow a curvilinear path conforming to the outside surface of a roll stiffens the blanks so as to substantially reduce the likelihood of wrinkling of the blanks during the scoring operation. The flexible mounts for the various rolls, in addition to the roll yoke mechanism provides the apparatus with a degree of flexibility not attained by the prior art envelope blank scoring and folding mechanisms.

Since many changes and variations of the disclosed embodiment of the invention may be made without departing from the inventive concept, it is not intended to limit the invention otherwise than as required by the appended claims.

What is claimed is:

1. A method of scoring and folding an envelope blank to form an envelope, said method comprising:

(a) moving an envelope blank along a rectilinear path;

(b) forming a lateral score line on said blank;

(c) moving said laterally scored blank along a curvilinear path while concurrently forming a pair of longitudinal score lines on said blank;

(d) halting movement of a leading edge of said blank while concurrently continuing movement of a trailing portion of said blank to invert said blank and fold the latter along said lateral score line;

(e) resuming movement of said inverted folded blank along a rectilinear path;

(f) applying gum to said blank adjacent said longitudinal score lines; and (g) folding said blank along said longitudinal score lines to complete formation of said envelope.

2. The method of claim 1 wherein said longitudinal score lines are formed on a leading portion of said blank forward of said lateral score line.

3. The method of claim 1 further comprising the steps of providing a chute; moving said leading edge of said blank into said chute from said curvilinear path; and halting movement of said leading edge of said blank while the latter is in said chute.

4. An apparatus for scoring and folding an envelope blank to form an envelope, said apparatus comprising:

(a) a first pair of rolls forming a first nip, one of said first pair of rolls being an internally evacuated roll operable to draw blanks down onto its outer surface and move the blanks along a curvilinear path conforming to said outer surface of said evacuated roll;

(b) means on said first pair of rolls for forming a lateral score line on a blank passing through said first nip;

(c) a longitudinal scoring roll cooperating with said evacuated roll to form a second nip downstream from said first nip and along said curvilinear path, said longitudinal scoring roll including means for forming at least one longitudinal score line on a blank moving along said curvilinear path and through said second nip;

(d) stop means adjacent to said evacuated roll and downstream of said second nip, said stop means being operable to engage a leading edge of a blank to stop movement of the leading edge of the blank while said evacuated roll continues to move trailing portions of the blank along said curvilinear path whereby the blank will be inverted and folded along its lateral score line; and (e) a pair of feed rolls disposed downstream of said stop means and said curvilinear path, said feed rolls forming a feed nip into which an inverted and laterally folded blank is fed.

5. The apparatus of claim 4 further comprising means for bias mounting of said longitudinal scoring roll to bias said longitudinal scoring roll toward said evacuated roll.

6. The apparatus of claim 4, further comprising a yoke mounted for pivotal movement about the axis of rotation of said evacuated roll, said yoke including first mounting means carrying said longitudinal scoring roll and operable to bias said longitudinal scoring roll toward said evacuated roll.

7. The apparatus of claim 6, wherein said yoke comprises second mounting means for mounting one of said feed rolls on said yoke, said second mounting means being operable to bias said one of said feed rolls toward said evacuated roll.

8. The apparatus of claim 7 further comprising means cooperating with said yoke to bias said one of said feed rolls toward the other of said feed rolls.

9. The apparatus of claim 6 further comprising adjustment means cooperating with said yoke to adjust the pivotal position of said yoke with respect to the axis of rotation of said evacuated roll.

10. An apparatus for scoring and folding an envelope blank to form an envelope, said apparatus comprising:

(a) a first pair of rolls forming a first nip, one of said first pair of rolls being an internally evacuated roll operable to draw blanks down onto its outer surface and move the blanks along a curvilinear path conforming to said outer surface of said evacuated roll;

(b) means on said first pair of rolls to form a lateral score line on a blank passing through said first nip;

(c) a yoke mounted for pivotal movement about the axis of rotation of said evacuated roll;

(d) a longitudinal scoring roll mounted on said yoke and cooperating with said evacuated roll to form a second nip downstream from said first nip and along said curvilinear path, said longitudinal scoring roll including means for forming at least one longitudinal score line on a blank moving along said curvilinear path and through said second nip;

(e) a first feed roll mounted on said yoke and cooperating with said evacuated roll to form a third nip downstream of said second nip and along said curvilinear path;

(f) stop means adjacent to said evacuated roll and downstream of said third nip, said stop means being operable to engage a leading edge of a blank to stop movement of the leading edge of the blank while said evacuated roll continues to move trailing portions of the blank whereby the blank will be inverted and folded along its lateral score line; and (g) a second feed roll mounted adjacent to said first feed roll and cooperating with the latter to form a feed nip downstream of said stop means, said first and second feed rolls being operable to feed inverted and laterally folded blanks away from said stop means.

11. The apparatus of claim 10, further comprising first biasing means mounted on said yoke for biasing said longitudinal scoring roll toward said evacuated roll.

12. The apparatus of claim 11, further comprising second biasing means mounted on said yoke for biasing said first feed roll toward said evacuated roll.

13. The apparatus of claim 12, further comprising third biasing means operably connected to said yoke to bias the latter about its pivotal axis and bias said first feed roll toward said second feed roll.

14. The apparatus of claim 13, further comprising adjustment means engaging said yoke to adjust the pivotal position of said yoke against the bias of said third biasing means.

15. The apparatus of claim 11, further comprising first release means for negating said first biasing means.

16. The apparatus of claim 12, further comprising second release means for negating said second biasing means.

17. The apparatus of claim 13, further comprising third release means for negating said third biasing means.

18. The apparatus of claim 10, further comprising adjustment means for adjusting the position of said stop means to adapt the apparatus to blanks of different longitudinal dimension.

* * * * *